US005528723A

United States Patent [19]

Gerson et al.

[11] Patent Number: 5,528,723

[45] Date of Patent: Jun. 18, 1996

[54] DIGITAL SPEECH CODER AND METHOD UTILIZING HARMONIC NOISE WEIGHTING

[75] Inventors: Ira A. Gerson, Hoffman Estates; Mark A. Jasiuk, Chicago, both of Ill.

[73] Assignee: Motorola, Inc., Schaumburg, Ill.

[21] Appl. No.: 303,271

[22] Filed: Sep. 7, 1994

Related U.S. Application Data

[63] Continuation of Ser. No. 21,639, Feb. 22, 1993, abandoned, which is a continuation of Ser. No. 635,046, Dec. 28, 1990, abandoned.

[51] Int. Cl.[6] ..... G10L 3/02

[52] U.S. Cl. ..... 395/2.2; 395/2.16; 395/2.18

[58] Field of Search ..... 381/29–40; 395/2, 395/2.16, 2.18, 2.2, 2.29–2.32

[56] References Cited

U.S. PATENT DOCUMENTS

| | | | |
|---|---|---|---|
| 4,817,157 | 3/1989 | Gerson | 381/40 |
| 4,868,867 | 9/1989 | Davidson et al. | 381/36 |
| 4,896,361 | 1/1990 | Gerson | 381/40 |
| 4,945,565 | 7/1990 | Dzawa et al. | 381/38 |
| 5,027,405 | 6/1991 | Dzawa | 381/40 |

OTHER PUBLICATIONS

Lee et al., "On Reducing Computational Complexity of Codebook Search in CELP Coding," IEEE Trans on Communications, vol. 38, No. 11, Nov. 1990, pp. 1935–1937.

*Primary Examiner*—David D. Knepper
*Attorney, Agent, or Firm*—Darleen J. Stockley

[57] ABSTRACT

A digital speech coder utilizes harmonic noise weighting to overcome some limitations of low-rate CELP-type speech coders in reproducing voiced speech. In addition to a short term correction factor, which constitutes spectral noise weighting as known in the art, a long term pitch correction factor is utilized to provide harmonic noise weighting. The inclusion of harmonic noise weighting in a speech coder more efficiently utilizes noise-masking properties of a speech signal, allowing synthesis of a higher quality speech at a given bit rate.

40 Claims, 2 Drawing Sheets

DIGITAL SPEECH CODER AND METHOD UTILIZING HARMONIC NOISE WEIGHTING

This is a continuation of application Ser. No. 08/021,639, filed Feb. 22, 1993 and now abandoned, which is a continuation of application Ser. No. 07/635,046, filed Dec. 28, 1990 and now abandoned.

FIELD OF THE INVENTION

The present invention is related to digital speech coding at low bit rates. More particularly, the present invention is directed to an improved method and coder for attenuating differences between synthesized digital speech signals and speech signals.

BACKGROUND OF THE INVENTION

Current Code Excited Linear Prediction (CELP) type speech coders utilize a code-book memory of excitation code book vectors and generally compute an error sequence, for example $e_i(n)$, where:

$$e_i(n)=s(n)-s_i(n),\ n=1,\ldots,N;\ i=1,\ldots,I$$

where s(n) is the input speech signal, $s_i(n)$ is the reconstructed speech signal corresponding to the codebook entry i, and N is a positive integer that specifies a number of samples that constitute a subframe. I typically specifies the number of entries in an excitation codebook. One criterion for selecting the best matching codebook entry is to select a vector $s'_i(n)$, which minimizes an error energy over an N point subframe, i.e., $$E_i=\sum_{n=1}^{N} e_i^2(n),\ i=1,\ldots,I$$

Thus, if $s'_K(n)$ is a vector that minimizes the error energy equation, the coder parameters used to generate it are transmitted to the receiver.

Typically, however, e(n) is passed through a spectral weighting filter prior to the error energy calculation. A spectral weighting filter seeks to equalize a signal-to-noise (SNR) ratio along a frequency axis by allowing more noise in the high energy regions of the spectrum, where the noise is masked by signal energy, and by allowing less noise in the spectral valleys. The spectral weighting filter, as known in the art, is derived from linear predictive coding (LPC) parameters that model the resonance characteristics of the vocal tract, or the spectral envelope. The spectral envelope is a slowly varying function of frequency that is characterized by short-term signal correlation. Typically, such a noise weighting filter is defined by transfer function H(z), where:

$$H(z)=\frac{A(z)}{A\left(\frac{z}{\alpha}\right)},\ 0\leqq\alpha<1.0$$

with $$A(z)=1-\sum_{i=1}^{N_p} a_i z^{-i}$$

and

-continued $$A\left(\frac{z}{\alpha}\right)=1-\sum_{i=1}^{N_p} a_i(\alpha z)^{-i}.$$

Commonly used values for the noise weighting constant are $0.7<\alpha<0.9$. $a_i$ are the direct form LPC filter coefficients, where $N_p$ is the order of the filter. Each error vector $e_i(n)$ is then spectrally weighted to yield $e_{is}(n)$. In the z transform notation, $E_{is}(z)=H(z)E_i(z)$ . The error energy is calculated as before, except that the spectrally weighted error vector $e_{is}$ is used:

$$E_{is}=\sum_{n=1}^{N} e_{is}^2(n),\ i=1,\ldots,I.$$

The vector $s'_i(n)$ that minimizes the spectrally weighted error over all I indices is then selected as the best one, and the parameters specifying it are transmitted to a receiver.

In the frequency domain, signal periodicity contributes peaks at the fundamental frequency and at the multiples of that frequency, i.e., harmonics of the fundamental frequency. There is a need for an improved noise weighting method that substantially de-emphasizes the importance of quantization noise in the vicinity of harmonics while increasing the noise penalty in troughs between the harmonics.

SUMMARY OF THE INVENTION

A device and method for a digital speech coder for generating at least a first modified reconstruction error parameter based on at least a reconstructed speech signal are described that, among other improvements, provide for substantially de-emphasizing the importance of quantization noise in the vicinity of harmonics while increasing the noise penalty in troughs between the harmonics, thereby smoothing the SNR along a frequency axis with respect to a magnitude spectrum of the input speech signal. The device for at least generating at least a first modified reconstruction error parameter for a digital speech coder having an input speech signal, wherein the at least first modified reconstruction error parameter is based on at least a first reconstruction error signal corresponding to at least a first reconstructed speech signal, comprises at least: determining means for determining at least a first periodicity corresponding to a periodicity of the input speech signal; first modification means, responsive to the determining means and to the at least first reconstruction error signal, for generating at least a first modified reconstruction error signal at least in correspondence with the at least a first periodicity of the input speech signal; and generating means, responsive to the at least first modified reconstruction error signal of the first modification means, for generating at least a first modified reconstruction error parameter. The method utilizes steps in correspondence with procedures inherently set forth above with the device.

BEST MODE FOR CARRYING OUT THE INVENTION

Figure 1:
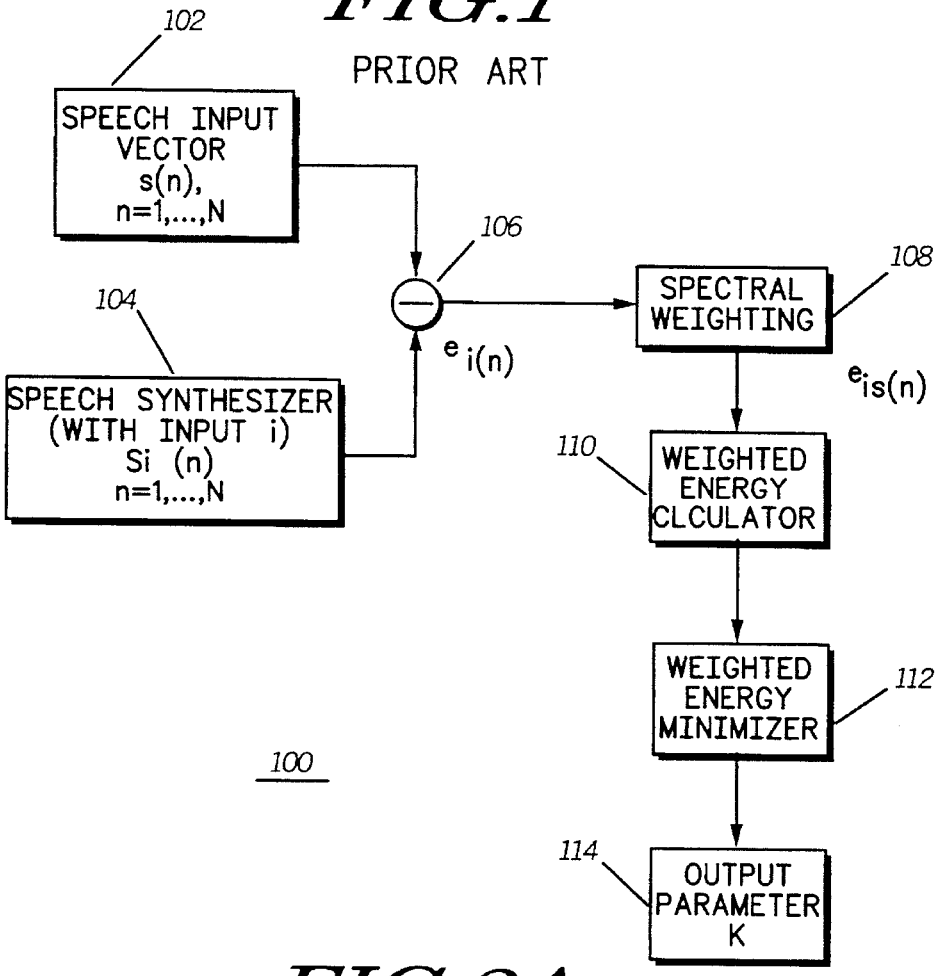
FIG.1 PRIOR ART
FIG. 1 illustrates a general block diagram of a prior art hardware implementation of a spectrally adjusted reconstruction error parameter generator.

FIG. 1, generally depicted by the numeral 100, illustrates a typical spectral adjustment hardware device for adjusting a reconstruction error signal based on an input speech signal and a reconstructed speech signal as is known in the art. The known art typically utilizes a speech input vector (102), s(n), and a speech synthesizer vector (with input i)(104), $s_i(n)$, wherein n=1, . . . ,N for both vectors that are input into a subtractor (106) to obtain an error vector $e_i(n)$, utilizes a spectral weighting unit (108) to obtain a spectrally weighted error vector ($e_{is}$), employs a weighted energy calculator (110) to determine spectrally weighted error energy, utilizes a weighted energy minimizer (112) to select a vector $s_{'i}(n)$ that minimizes spectrally weighted error energy over all values for i, and provides an output parameter K (114) specifying to a receiver an index of the parameter i that minimizes spectrally weighted error energy at a selected subframe.

Figure 2A:
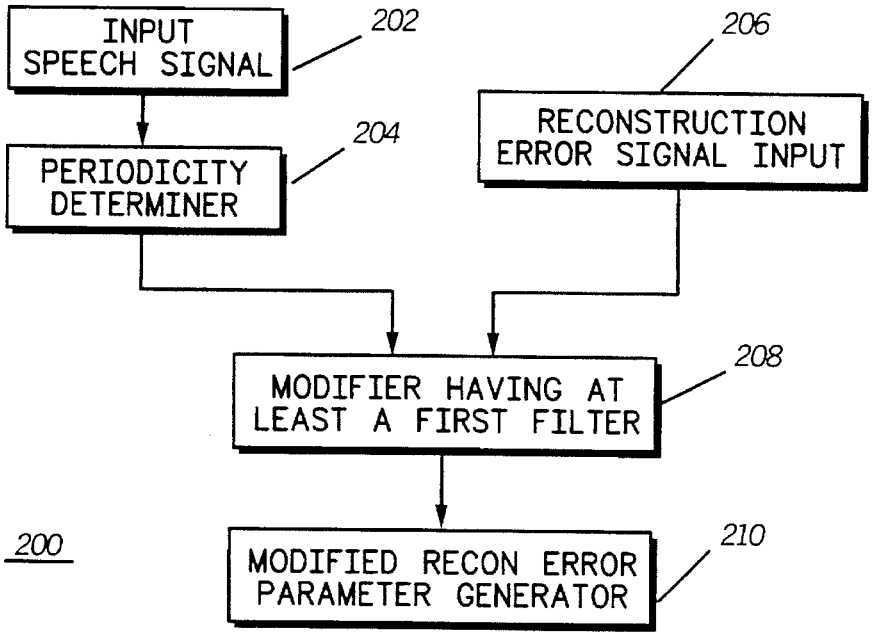
FIG. 2A illustrates a general block diagram of a hardware implementation in accordance with the present invention.

FIG. 2A, numeral 200, illustrates a hardware implementation according to the present invention that, upon provision of an input speech signal (202) and at least a first reconstruction error signal input (206), provides further speech synthesizer excitation vector adjustment by supplying a modified reconstruction error parameter that utilizes a harmonic noise weighting function. At least a first periodicity of an input speech signal (202) that is typically at least converted to a sequence of N pulse samples, each having an amplitude represented by a digital code, is substantially determined by a periodicity determiner (204) as is known in the art. A typical speech sampling rate is 8000 kHz. The at least first reconstruction error signal input (206), obtained as is known in the art, is applied to a modifier (208) together with the at least first periodicity of the input speech signal.

Figure 2B:
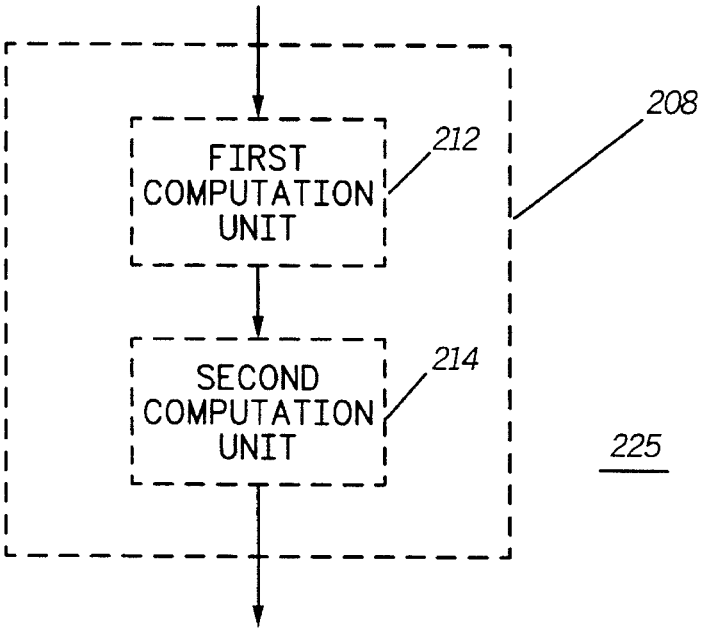
FIG. 2B further illustrates a selective portion of the present invention illustrated in FIG. 2A.

The modifier (208) generates at least a first modified reconstruction error signal, further illustrated in FIG. 2B. A first computation means (212), where desired, provides an adjustment, utilizing at least a second computation unit (214), with at least a first filter based on at least one long term correlation vector that may be represented by a polynomial, substantially of a form:

$$\epsilon_p \sum_{i=-M_1}^{M_2} p_i x(n-L+i),\ n=1,\ldots,N \text{ and}$$

such that $0 \leqq \epsilon_p \leqq 1$, $(M_1+M_2+1)$ specifies a number of terms in the summation, $p_i$'s are filter coefficients, x(n) is an input signal to the first modification means, and L is substantially a delay in samples which is related to the periodicity of the input speech signal. For voiced speech L corresponds substantially to a pitch period of a speech signal in samples or, if desired, may be selected to correspond to a multiple of the pitch period at a given subframe. $M_1$ and $M_2$ are selected values for a desired summation range. $\epsilon_p$ substantially specifies a selected amount of long term correlation to be removed: for $\epsilon_p$ substantially equal to zero, no long term correlation is removed, and for $\epsilon_p$ substantially equal to 1, the maximum amount of long term correlation is removed. Typical values for $\epsilon_p$ are substantially between 0.3 and 0.7. $p_i$ filter coefficients are determined to maximize the at least first filter prediction gain at a selected subframe. Upon utilizing the at least first long term prediction vector, an output, y(n), from the first filter, is obtained, substantially being:

$$y(n) = x(n) - \epsilon_p \sum_{i=-M_1}^{M_2} p_i x(n-L+i).$$

It is clear that L may be determined prior to $p_i$ coefficient determination, or, where desired, L and $p_i$ may be jointly optimized. Order of the at least first filter is substantially equivalent to $M_1+M_2+1$. $M_1$ and $M_2$ values typically range from 0 to 4. Utilizing $M_1=1$ and $M_2=1$ typically yields a good compromise between performance and complexity.

Where $(M_1+M_2+1)$ is greater than one, the at least first filter is a multi-tap filter such that, in addition to performing long term correlation removal, short term correlation may be introduced. Where desired, to control the short term correlation introduced, an at least second filter may be utilized, the at least second filter being cascaded with the first filter and having a transfer function, B(z), substantially of a form:

$$B(z) = 1 - \epsilon_b \sum_{i=1}^{J} b_i z^{-1},$$

where J is a positive integer and where the $b_i$'s are determined from at least the $p_i$'s and $0 \leqq \epsilon_b \leqq 1$, such that a second output generator provides a second output, y'(n), substantially of a form:

$$y'(n) = v(n) - \epsilon_b \sum_{i=1}^{J} b_i v(n-i).,$$

where n=1, . . . ,N where v(n) is an input to the second output generator.

Typically, to generate the $b_i$'s, the at least second filter coefficients, $R_p(j)$ , an autocorrelation of an impulse response of the at least first filter, is calculated for j=0, . . . ,$(M_1+M_2)$, wherein $R_p(j)$ is substantially:

$$R_p(0) = 1 + (\epsilon_p)^2 \sum_{i=-M_1}^{M_2} (p_i)^2 \text{ and}$$

$$R_p(j) = (\epsilon_p)^2 \sum_{i=-M_1}^{M_2-j} (p_{i+j})(p_i),\ j=1,\ldots,(M_1+M_2).$$

Generally, the $b_i$ coefficients are computed via the Levinson recursion given values of $R_p(j)$ and the order of the at least second filter, $(M_1+M_2)$. The $\epsilon_b$ parameter determines the degree of compensation applied by the at least second filter. Setting $\epsilon_b$ substantially equal to one provides application of a full prediction gain of B(z) to the removal of the short term correlation introduced by the at least first filter. Typical values for $\epsilon_b$ span the entire range for which it is defined.

Thus, full utilization of the harmonic noise weighting function is typically implemented by cascading at least a first and at least a second filter:

$$E_{ish}(z) = P(z)B(z)E_{is}(z)$$

or equivalently $$E_{ish}(z) = H(z)P(z)B(z)E_i(z)\ ,$$

as set forth above. To maximize speech coder performance, the harmonic noise weighting function is combined with the spectral weighting function. Thus, the noise masking properties of both the long term signal correlation and the short term signal correlation are utilized. A spectrally and harmonically weighted error energy, corresponding to a $s'_i(n)$ vector that substantially minimizes spectrally and harmonically weighted error energy at a subframe over all I values, is determined by a modified reconstruction (RECON) error parameter generator (210), being substantially:

$$E_{ish} = \sum_{n=1}^{N} e_{ish}^2(n),\ n = 1, \ldots, N$$

and parameters specifying that $s'_i(n)$ vector are transmitted to a receiver. Vectors of a digital speech coder parameter, typically selected from a codebook of said vectors, have a vector dimension of at least one.

While the filters have been cascaded in a specific order in the above description, an alternate sequencing of weighting polynomials may also be beneficially utilized.

Correspondence/substantial equivalence is defined to be, substantially, a matching within predetermined boundary conditions.

Figure 3:
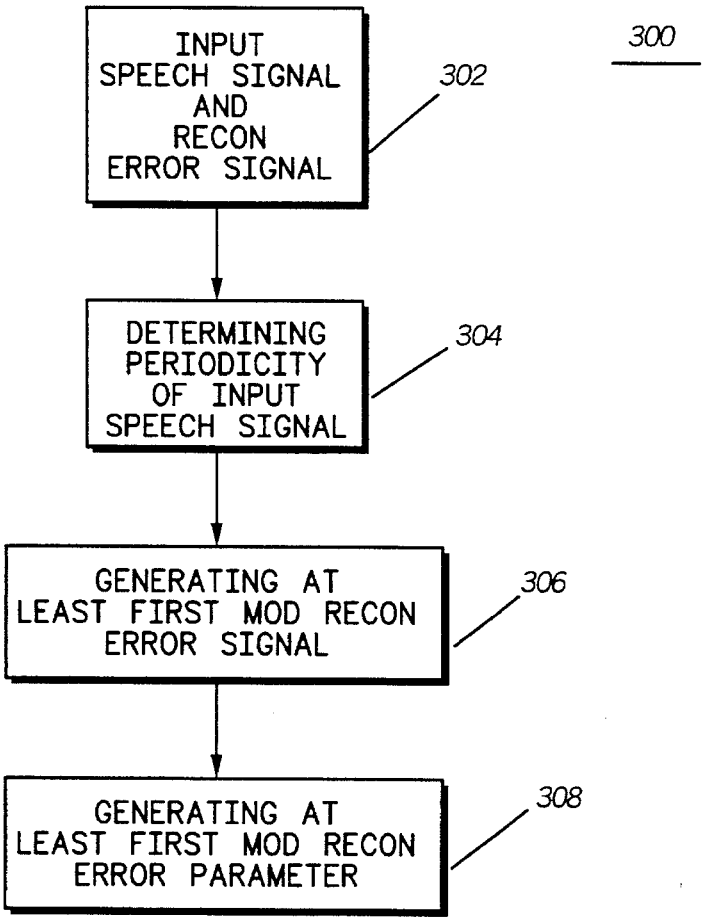
FIG. 3 is a flow diagram illustrating the steps executed in accordance with the method of the present invention.

FIG. 3, numeral 300, sets forth a flow diagram describing the steps in accordance with the present invention, such that a reconstructed error signal is determined in correspondence with the input speech signal periodicity. An input speech signal and a reconstruction error signal are input (302), typically such that the input speech signal and the reconstruction error signal are adjusted in accordance with a spectral envelope correlation vector (prior art spectral weighting) associated therewith individually prior to determination of a reconstruction error. The periodicity of the input speech signal is determined (304) and the reconstruction error signal (RES) is modified (306) as set forth above.

The utilization of harmonic noise weighting to extend noise weighting methodology thus enables synthesis of higher quality synthetic speech at a given bit rate, and is particularly useful in a radio incorporating digital speech transmission.

We claim:

1. A method for generating at least a first modified reconstruction error parameter for a digital speech coder having an input speech signal, wherein each modified reconstruction error parameter is based on a reconstruction error signal that corresponds to at a reconstructed speech signal, comprising the steps of:

A) utilizing a periodicity determiner in the digital speech coder for determining a periodicity corresponding to a periodicity of the input speech signal;

B) utilizing a digital speech coder modification unit in the digital speech coder, responsive to the periodicity determiner and to the reconstruction error signal, for generating the modified reconstruction error signal based on harmonic noise weighting in correspondence with the periodicity of the input speech signal utilizing a filter unit which attenuates the frequency components at multiples of the frequency corresponding to the periodicity of the input speech signal wherein the digital speech coder modification means further includes a computation means for determining at least one short term correlation vector, and an adjustment means for modifying the reconstruction error signal based on at least one short term correlation vector; and C) utilizing a digital speech coder generating unit in the digital speech coder, responsive to the modified reconstruction error signal of the digital speech coder modification means, for generating at least the modified reconstruction error parameter.

2. A device for generating at least a first modified reconstruction error parameter for a digital speech coder having an input speech signal, wherein the at least first modified reconstruction error parameter is based on a reconstruction error signal corresponding to a reconstructed speech signal, comprising:

A) a periodicity determiner in the digital speech coder, for determining a periodicity corresponding to a periodicity of the input speech signal;

B) digital speech coder modification unit in the digital speech coder, responsive to the periodicity determiner and to the reconstruction error signal, for generating the modified reconstruction error signal based on harmonic noise weighting in correspondence with the periodicity of the input speech signal utilizing a filter unit which attenuates the frequency components at multiples of the frequency corresponding to the periodicity of the input speech signal wherein the digital speech coder modification unit further includes a computation unit for determining at least one short term correlation vector, and an adjustment unit for modifying the reconstruction error signal based on at least one short term correlation vector; and C) digital speech coder generating unit in the digital speech coder, responsive to the modified reconstruction error signal of the digital speech coder modification unit, for generating at least the modified reconstruction error parameter.

3. The device of claim 1, further including a first digital speech coder parameter determining means for determining a first digital speech coder parameter of the digital speech coder utilizing the modified reconstruction error parameter.

4. The device of claim 3, wherein the first digital speech coder parameter determining means includes:

first selection means for selecting a set of vectors, where vector dimension is at least one, of a digital speech coder parameter from a codebook of vectors of that parameter;

second determining means responsive to the set of vectors of the first selection means for generating a set of modified reconstruction error parameters; and second selection means responsive to the set of modified reconstruction error parameters for selecting a modified reconstruction error parameter from the said set and to output an indication of the codebook vector corresponding to the selected modified reconstruction error parameter.

5. The device of claim 1, wherein the modification means includes second computation means for determining at least a first long term prediction vector, being substantially of a form:

$$\epsilon_p \sum_{i=-M_1}^{M_2} p_i x(n-L+i),$$

n=1, . . . ,N and such that $0 \leqq \epsilon_p \leqq 1$, $(M_1+M_2+1)$ specifies a number of terms in the summation, $p_i$'s are filter coefficients (as multiplied by $\epsilon_p$) for the filter, x(n) is an input signal to the modification means, and L is a delay related to the periodicity of the input speech signal.

6. The device of claim 5, wherein a value of $\epsilon_p$ in the range $0 \leqq \epsilon_p \leqq 1$ is selectable at different predetermined times.

7. The device of claim 5, further including first output means such that upon utilizing the at least first long term prediction vector, the first output means provides a first output, y(n), of a form:

$$y(n)=x(n)-\epsilon_p \sum_{i=-M_1}^{M_2} p_i x(n-L+i).$$

8. The device of claim 5, further including at least a second modification means that includes a filter cascaded with the filter of claim 1(B) having a transfer function, B(z), of a form:

$$B(z)=1-\epsilon_b \sum_{i=1}^{J} b_i z^{-1},$$

where J is a positive integer and where the $b_i$'s are determined from at least the $p_i$'s and $0 \leqq \epsilon_b \leqq 1$.

9. The device of claim 8, further including second output means such that upon utilizing the transfer function B(z), the second output means provides a second output, y'(n), of a form:

$$y'(n)=v(n)-\epsilon_b \sum_{i=1}^{J} b_i v(n-i).,$$

where n=1, . . . ,N and v(n) is an input to the second output means.

10. The device of claim 9, wherein a value of $\epsilon_b$ in the range $0 \leqq \epsilon_b \leqq 1$ is selectable at different predetermined times.

11. A device for generating at least a first reconstruction error parameter for a digital speech coder wherein the at least first reconstruction error parameter is based on an input speech signal and an input reconstructed speech signal, comprising at least:

A) a periodicity determiner in the digital speech coder, for determining at least one periodicity corresponding to a periodicity of the input speech signal;

B) computation unit in the digital speech coder, responsive to the periodicity determiner, for determining at least a first long term prediction vector, being substantially of a form:

$$\epsilon_p \sum_{i=-M_1}^{M_2} p_i x(n-L+i),$$

n=1, . . . ,N and such that $0 \leqq \epsilon_p \leqq 1$, $(M_1+M_2+1)$ specifies a number of terms in the summation, $p_i$'s are filter coefficients (as multiplied by $\epsilon_p$) specifying a first filter which attenuates the frequency components at multiples of the frequency corresponding to the periodicity of the input speech signal, x(n) is an input signal to the commutation unit, and L is a delay related to the periodicity of the input speech signal;

C) first output unit of the digital speech coder such that upon utilizing the first filter specified by the at least first long term prediction vector, the first output unit provides an output, y(n) based on harmonic noise weighting, of a form:

$$y(n)=x(n)-\epsilon_p \sum_{i=-M_1}^{M_2} p_i x(n-L+i)$$

wherein the modified reconstruction error parameter is based at least on y(n), wherein the second computation unit further includes:

second determining unit for determining a transfer function, B(z), for a second filter cascaded with the first filter of a form:

$$B(z)=1-\epsilon_b \sum_{i=1}^{J} b_i z^{-1},$$

where J is a positive integer the $b_i$'s are determined from the $p_i$'s $0 \leqq \epsilon_b \leqq 1$; and second output unit responsive to the second determining unit for at least utilizing the filter having the transfer function B(z), the second output unit to provide a second output, y'(n), of a form:

$$y'(n)=v(n)-\epsilon_b \sum_{i=1}^{J} b_i v(n-i).,$$

where n=1, . . . ,N and v(n) is an input to the second output unit.

12. The device of claim 11, wherein a value of $\epsilon_p$ in the range $0 \leqq \epsilon_p \leqq 1$ is selectable at different predetermined times.

13. The device of claim 11, further including at least one digital speech coder parameter determining means for utilizing the modified reconstruction error signal to determine at least one parameter of the digital speech coder.

14. The device of claim 13, wherein the at least one digital speech coder parameter determining means further includes:

first selection means for selecting a vector, where vector dimension is at least one, of a digital speech coder parameter from a codebook of vectors of that parameter;

second determining means responsive to the set of vectors of the first selection means for generating a set of modified reconstruction error parameters; and second selection means responsive to the set of modified reconstruction error parameters for selecting a modified reconstruction error parameter from the said set and to output an indication of the codebook vector corresponding to the selected modified reconstruction error parameter.

15. The device of claim 11, further including a first computation means for determining at least one short term correlation vector, and wherein the first modification means further includes at least a correction means for utilizing at least one short term correlation vector to modify the reconstruction error signal.

16. A method for generating at least one modified reconstruction error parameter based on harmonic noise weighting for modification of a reconstruction error signal in a digital speech coder wherein the reconstruction error signal is based on at least an input speech signal and an input reconstructed speech signal, comprising at least the steps of:

A) determining at least one periodicity in a digital speech coder determining unit corresponding to a periodicity of the input speech signal;

B) generating at least a modified reconstruction error signal in a digital speech coder modification unit by utilizing attenuation of frequency components in the reconstruction error signal which correspond to multiples of a frequency corresponding to the periodicity of the input speech signal including utilizing a filter having a transfer function, B(z), of a form:

$$B(z)=1-\epsilon_b \sum_{i=1}^{J} b_i z^{-1},$$

where J is a positive integer and where the $b_i$'s are determined from at least the $p_i$'s and $0 \leqq \epsilon_b \leqq 1$; and C) generating, in a digital speech coder generating unit, in view of at least the modified reconstruction error signal, at least a modified reconstruction error parameter.

17. The method of claim 16, further including a step of utilizing the modified reconstruction error parameter to determine at least one digital speech coder parameter.

18. The method of claim 17, wherein the step of utilizing the modified reconstruction error parameter to determine at least one digital speech coder parameter further includes at least the steps of:

selecting a vector, where vector dimension is at least one, of a digital speech coder parameter from a codebook of vectors of that parameter;

generating a set of modified reconstruction error parameters; and selecting a modified reconstruction error parameter from the said set and outputting an indication of the codebook vector corresponding to the selected modified reconstruction error parameter.

19. The method of claim 16, further including at least a step of determining at least one short term correlation vector, and modifying the reconstruction error signal based on at least one short term correlation vector.

20. The method of claim 16, further including a step of determining at least a first long term prediction vector, being substantially of a form:

$$\epsilon_p \sum_{i=-M_1}^{M_2} p_i x(n-L+i),$$

n=1, . . . ,N and such that $0 \leqq \epsilon_p \leqq 1$, $(M_1+M_2+1)$ specifies a number of terms in the summation, $p_i$'s are filter coefficients (as multiplied by $\epsilon_p$) for a filter used for generating at least a first modified reconstruction error signal at least in correspondence with the periodicity of the input speech signal, x(n) is an input signal to the step of modifying the reconstruction error signal, and L is a delay related to the periodicity of the input speech signal.

21. The device of claim 20, wherein a value of $\epsilon_p$ in the range $0 \leqq \epsilon_p \leqq 1$ is selectable at different predetermined times.

22. The method of claim 20, further including a step of utilizing the first long term prediction vector to provide an output, y(n), of a form:

$$y(n) = x(n) - \epsilon_p \sum_{i=-M_1}^{M_2} p_i x(n-L+i).$$

23. The method of claim 16, further including a step of at least utilizing the transfer function B(z) to provide a second output, y'(n), of a form:

$$y'(n) = v(n) - \epsilon_b \sum_{i=1}^{J} b_i v(n-i).,$$

where n=1, . . . ,N and v(n) is an input to the second output.

24. The method of claim 16, wherein a value of $\epsilon_b$ in the range $0 \leqq \epsilon_b \leqq 1$ is selectable at different predetermined times.

25. A digital speech coder device for generating at least a modified reconstruction error parameter having an input speech signal, wherein the modified reconstruction error parameter is based on a reconstruction error signal corresponding to a reconstructed speech signal, comprising:

A) a periodicity determining unit, for determining a periodicity corresponding to a periodicity of the input speech signal;

B) modification unit, responsive to the periodicity determiner (i.e., a pitch calculator), and to the reconstruction error signal, for generating a modified reconstruction error signal in correspondence with the periodicity of the input speech signal utilizing a filter whose parameters are related to the periodicity of the input speech signal, wherein the filter based on harmonic noise weighting which attenuates the frequency components at multiples of the frequency corresponding to the periodicity of the input speech signal is determined by a long term prediction vector, being substantially of a form:

$$\epsilon_p \sum_{i=-M_1}^{M_2} p_i x(n-L+i),$$

n=1, . . . ,N and such that $0 \leqq \epsilon_p \leqq 1$, $(M_1+M_2+1)$ specifies a number of terms in the summation, $p_i$'s are the filter coefficients (as multiplied by $\epsilon_p$), x(n) is an input signal to the modification means, and L is a delay related to the periodicity of the input speech signal; and C) generating unit, responsive to the modified reconstruction error signal of the modification device means, for generating at least a modified reconstruction error parameters.

26. The device of claim 25, further including at least a first digital speech coder parameter determining means for determining a first digital speech coder parameter of the digital speech coder utilizing the modified reconstruction error parameter.

27. The device of claim 26, wherein the at least first digital speech coder parameter determining means includes:

first selection means for selecting a set of vectors, where vector dimension is at least one, of a digital speech coder parameter from a codebook of vectors of that parameter;

second determining means responsive to the set of vectors of the first selection means for generating a set of modified reconstruction error parameters; and second selection means responsive to the set of modified reconstruction error parameters for selecting a modified reconstruction error parameter from the said set and to output an indication of the codebook vector corresponding to the selected modified reconstruction error parameter.

28. The device of claim 25, wherein the first modification means further includes a first computation means for determining at least one short term correlation vector, and an adjustment means for modifying the reconstruction error signal based on at least one short term correlation vector.

29. The device of claim 25, wherein a value of $\epsilon_p$ in the range $0 \leqq \epsilon_p \leqq 1$ is selectable at different predetermined times.

30. The device of claim 25, further including first output means such that upon utilizing the filter specified by the long term prediction vector, the first output means provides a first output, y(n), of a form:

$$y(n) = x(n) - \epsilon_p \sum_{i=-M_1}^{M_2} p_i x(n-L+i).$$

31. The device of claim 25, further including at least a second modification means having a filter with a transfer function, B(z), of a form:

$$B(z) = 1 - \epsilon_b \sum_{i=1}^{J} b_i z^{-1},$$

where J is a positive integer and where the $b_{i's}$ are determined from at least the $p_i$'s and $0 \leqq \epsilon_b \leqq 1$.

32. The device of claim 31, further including second output means such that upon utilizing the filter having the transfer function B(z), the second output means provides a second output, y'(n), of a form:

$$y'(n) = v(n) - \epsilon_b \sum_{i=1}^{J} b_i v(n-i).,$$

where n=1, . . . ,N and v(n) is an input to the second output means.

33. The device of claim 32, wherein a value of $\epsilon_b$ in the range $0 \leqq \epsilon_b \leqq 1$ is selectable at different predetermined times.

34. A device for generating at least a first reconstruction error parameter for a digital speech coder wherein the at least first reconstruction error parameter is based on an input speech signal and an input reconstructed speech signal, comprising at least:

A) first determining means for determining at least one periodicity corresponding to a periodicity of the input speech signal;

B) computation means, responsive to the first determining means for determining at least a first long term prediction vector, being substantially of a form:

$$\epsilon_p \sum_{i=-M_1}^{M_2} p_i x(n-L+i),$$

n=1, . . . ,N and such that $0 \leqq \epsilon_p \leqq 1$, $(M_1+M_2+1)$ specifies a number of terms in the summation, $p_i$'s are filter coefficients, x(n) is an input signal to the first modification means, and L is a delay related to the periodicity of the input speech signal;

C) first output means such that upon utilizing the at least first long term prediction vector, the first output means provides at least a first output, y(n), based on harmonic noise weighting, of a form:

$$y(n) = x(n) - \epsilon_p \sum_{i=-M_1}^{M_2} p_i x(n-L+i)$$

wherein the modified reconstruction error parameter is based at least on y(n).

35. The device of claim 34, wherein, where desired, the second computation means further includes:

second determining means for determining at least a transfer function, B(z), of a form:

$$B(z) = 1 - \epsilon_b \sum_{i=1}^{J} b_i z^{-1},$$

where J is a positive integer the $b_i$'s are determined from the $p_i$'s, $0 \leqq \epsilon_b \leqq 1$; and second output means responsive to the second determining means for at least utilizing the transfer function B(z), the second output means to provide a second output, y'(n), of a form:

$$y'(n) = v(n) - \epsilon_b \sum_{i=1}^{J} b_i v(n-i).,$$

where n=1, . . . ,N and v(n) is an input to the second output means.

36. The device of claim 35, wherein $\epsilon_b$ is a function of time.

37. The device of claim 34, wherein $\epsilon_p$ is a function of time.

38. The device of claim 34, further including at least one digital speech coder parameter determining means for utilizing the modified reconstruction error signal to determine at least one parameter of the digital speech coder.

39. The device of claim 38, wherein the at least one digital speech coder parameter determining means further includes:

first selection means for selecting a vector, where vector dimension is at least one, of a digital speech coder parameter from a codebook of vector of that parameter;

second determining means responsive to the set of vectors of the first selection means for generating a set of modified reconstruction error parameters; and second selection means responsive to the set of modified reconstruction error parameters for selecting a modified reconstruction error parameter from the said set and to output an indication of the codebook vector corresponding to the selected modified reconstruction error parameter.

40. The device of claim 34, wherein the computation means further determines at least one short term correlation vector, and includes at least a correction means for utilizing at least one short term correlation vector to modify the reconstruction error signal.

* * * * *

UNITED STATES PATENT AND TRADEMARK OFFICE

CERTIFICATE OF CORRECTION

PATENT NO. : 5,528,723

DATED : June 18, 1996

INVENTOR(S) : Ira A. Gerson and Mark A. Jasiuk

It is certified that error appears in the above-indentified patent and that said Letters Patent is hereby corrected as shown below:

Column 7, Line 50 "commutation" should read -computation-.

Signed and Sealed this

Seventeenth Day of September, 1996

*Attest:*

Bruce Lehman

BRUCE LEHMAN

*Attesting Officer*

*Commissioner of Patents and Trademarks*